US005909929A

United States Patent [19]

Chen

[11] Patent Number: 5,909,929

[45] Date of Patent: Jun. 8, 1999

[54] SUPPORTING BRACKET FOR A MIDDLE CUTTER OF A SHAVER

[76] Inventor: Chin-Chuan Chen, No. 25, Alley 53, Lane 514, Chung-Cheng Rd., Hsin-Chuang City, Taipei Hsien, Taiwan

[21] Appl. No.: 08/903,416

[22] Filed: Jul. 30, 1997

[51] Int. Cl.[6] ..... B26B 19/02; B26B 19/28

[52] U.S. Cl. ..... 30/43.92; 30/45

[58] Field of Search ..... 30/43.92, 43.9, 30/42, 45

[56] References Cited

U.S. PATENT DOCUMENTS

| | | | |
|---|---|---|---|
| 2,233,349 | 2/1941 | Lightfoot et al. | 30/43.92 X |
| 2,325,606 | 8/1943 | Hanley | 30/43.92 |
| 2,591,403 | 4/1952 | Carissimi | 30/43.92 |
| 2,629,169 | 2/1953 | Kleinman | 30/43.92 X |
| 2,859,513 | 11/1958 | Bylund | 30/43.92 |
| 3,456,341 | 7/1969 | Loner et al. | 30/43.92 X |

*Primary Examiner*—Rinaldi I. Rada
*Assistant Examiner*—Ana Luna
*Attorney, Agent, or Firm*—Smith, Gambrell & Russell, LLP; Beveridge, DeGrandi, Weilacher & Young Intellectual Property Group

[57] ABSTRACT

A middle cutter of a shaver includes a comb, comb mounts, a cutter, a cutter mount, a pair of spring plates, and a pair of steel balls for holding the cutter mount in a floating manner. The comb has an upper surface that includes a plurality of isolated openings. Each comb mount includes a retaining groove that retains the spring plates. The cutter, which includes a plurality of cutting grooves, is arranged in tight contact with an inner surface of the comb, such that the cutting grooves act with the comb openings to providing the shaving action. The steel balls are movably received on the spring plates such that upper portions of the steel balls are biased against the cutter mount by the spring plates so that the cutter mount is held in a balanced manner and maintains tight contact between the cutter and the comb.

12 Claims, 7 Drawing Sheets

SUPPORTING BRACKET FOR A MIDDLE CUTTER OF A SHAVER

FIELD OF THE INVENTION

The present invention relates to a supporting bracket, and more particularly, to an improved supporting bracket for a middle cutter of a shaver, in which the middle cutter is precisely aligned with the shaver comb without offsetting. Accordingly, the beard will not be clipped by an enlarged gap formed between the cutter and the comb.

DESCRIPTION OF THE PRIOR ART

In a twin-hump type shaver, there is a gap between two oscillating cutters, like that shown in U.S. Pat. No. 5,551,154. In order to narrow the gap between the twin-humps, a shaver having a middle supporting bracket was developed. As shown in FIGS. 6 to 8, the shaver includes a middle cutter 40 and side cutters 10. The middle cutter 40 serves for primary cutting, i.e., for cutting comparatively longer beards. The side cutters 10 are used for secondary cutting, i.e., for cutting comparatively shorter beards. This shaver is similar to the existing oscillating shaver in which a comb 41 and a movable cutter 44 are provided. The cutter 44 is connected to an oscillating shaft 51 of a motor 50 by means of a linkage 49 having a recess 491 in which the oscillating shaft 51 is engaged. Once the motor 50 is powered, the cutter 44 is driven to move in an oscillating manner such that the beard inserted through the comb 41 can be quickly cut off. The comb 41 is provided with a plurality of openings 42, and each of the openings 42 is spaced apart from and parallel with each other. The comb 41 is further provided with a projected peripheral 43. The upper surface of the cutter 44 is provided with a plurality of cutting grooves 45. The inserted beard can be cut off by the relative movement between the openings 42 of the comb 41 and the cutting grooves 45 of the cutter 44. The linkage 49 of the cutter 44 is provided with a retainer 48 having a short stud 481 thereon. The linkage 47 is also provided with a dowel 471 corresponding to the short stud 481. A spring 46 can be disposed between the short stud 481 and the dowel 471 such that the linkage 47 can be provided with a suitable biasing force. However, this coil spring 46 can be readily skewed or offset when excess loads are applied. As a result, a comparatively larger gap will be formed between the comb and the cutter, i.e., the inserted beard can not be effectively cut using the openings 42 and the cutting grooves 45. Instead, the inserted beard will be clipped-and-pulled by the gap formed therebetween. This is really undesirable because the user will experience an uncomfortable feeling. Even when the gap between the comb and the side portion of the cutter is quite small, a transverse movement of the cutter will still be experienced. If the gap is increased, the shifting becomes increasingly worse. This is really unacceptable to the user. On the other hand, if the middle cutter is not provided with suitable flexibility, i.e., it is too rigid, the cutter is not supported in a floating manner. Accordingly, there is a requirement in the art for an improved middle cutter assembly.

SUMMARY OF THE INVENTION

It is the objective of this invention to provide an improved supporting bracket for the middle cutter assembly of a shaver. This middle cutter assembly is disposed at the middle portion of a shaving head of a twin-hump shaver. Both ends of the cutter mount are properly supported by a steel ball, which in turn is biased with a W-shaped spring plate. Each spring plate is retained in a retaining groove located in a comb mount. By this arrangement, the cutter mount is precisely supported such that tightness between the cutter and the comb can be ensured. By this arrangement, the inserted beard can be accurately cut off by relative movement between the comb and the cutter. The comb and the cutter are configured to have a concave shape. Since the cutter mount is properly supported by a vertical force provided by the steel ball and the W-shaped spring plate, oscillating movement of the cutter mount is ensured. The comb and the cutter are ensured to be in close contact, with smooth movement therebetween. The frictional force between the comb and the cutter can be lowered and, in this manner, a more smooth operation can be attained. The cutter mount is provided with a pair of driving arms that define a gap therebetween. A U-shaped spring is retained in the gap, and the U-shaped spring is further connected to the driving head of a motor. By this arrangement, the cutter mount is provided with more flexibility, i.e., the cutter mount is supported in a more floating manner.

In order to achieve the objective set forth, the middle cutter assembly must be readily installed in the middle position of the shaving head of a shaver. The cutter assembly includes a comb which is releasably mounted onto a comb mount. The cutter is closely contacted with the inner surface of the comb. The cutter is releasably attached to the cutter mount, both ends of which in turn are supported by a steel ball that is biased by the W-shaped spring plate. Each W-shaped spring plate is retained on a retaining groove disposed on the comb mount.

BRIEF DESCRIPTION OF THE DRAWINGS

In order that the present invention may be more readily understood, the following description is given, merely by way of example, with reference to the accompanying drawings, in which.

DETAILED DESCRIPTION OF THE PREFERRED EMBODIMENT

Figure 1:
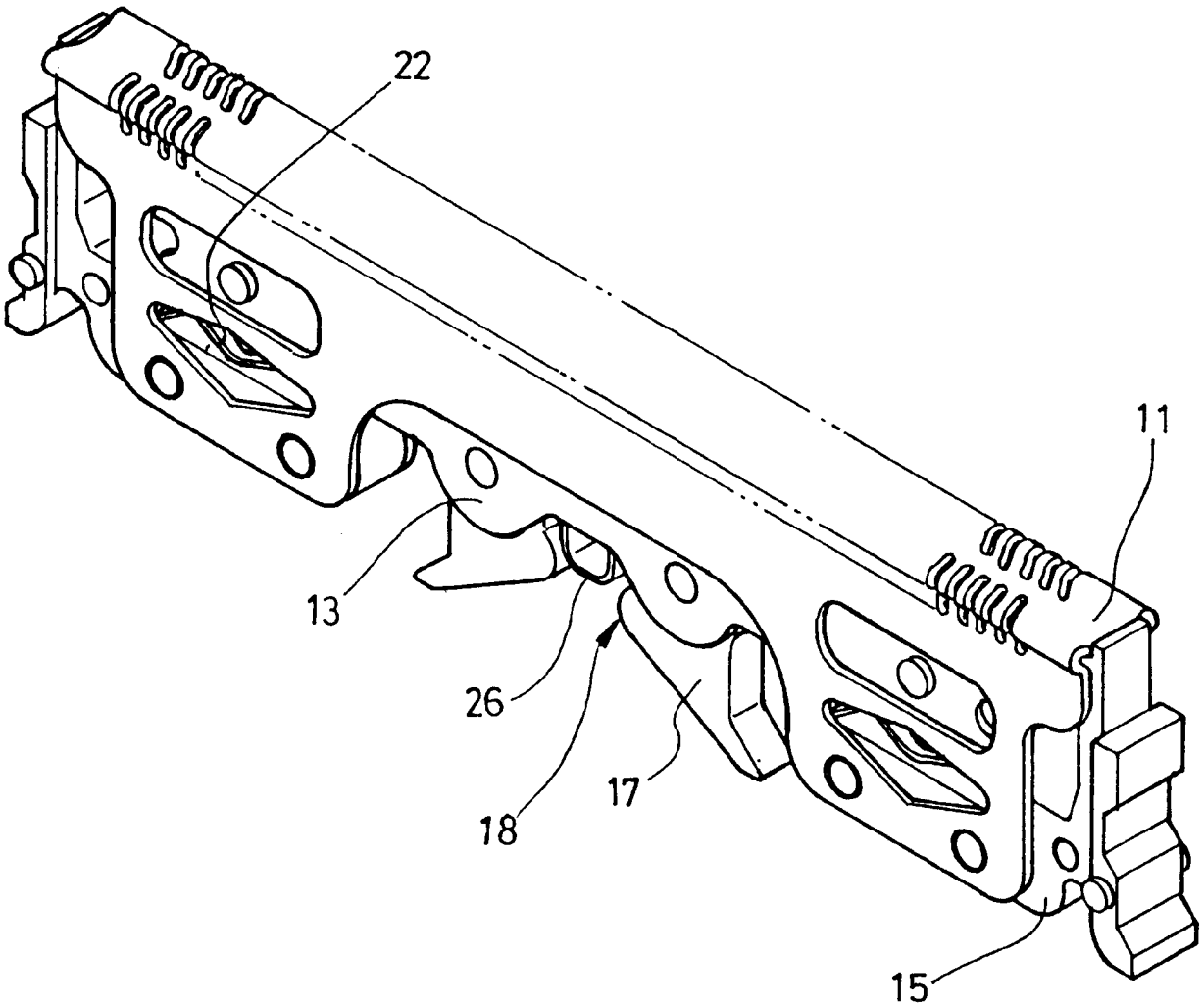
FIG. 1 is a perspective view of a supporting bracket made according to the present invention.
Figure 2:
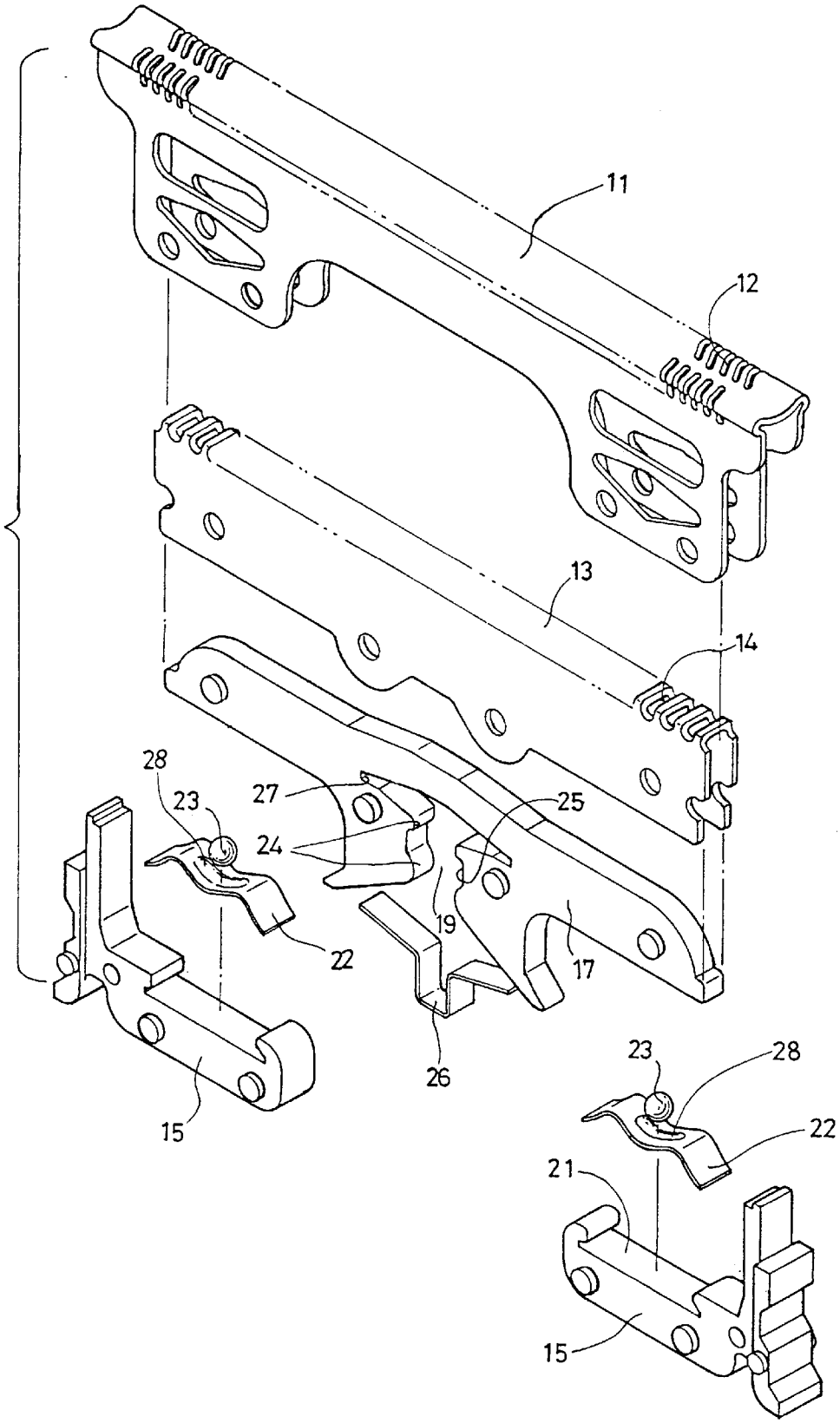
FIG. 2 is an exploded perspective view of the supporting bracket shown in FIG. 1.

Referring to FIGS. 1 to 5, a middle supporting bracket is disposed in the middle position of an oscillating shaver of the type that has a comb with two humps. The shaver includes a housing for holding a motor, a driving mechanism, and a power supply. The top of the housing is installed with a shaving head, which includes a supporting bracket and a cutter assembly. The cutter assembly includes a middle cutter and a pair of side cutters. The cutter assembly is covered by a comb, and beards can be cut by the joint and relative movement between the cutter assembly and the comb. Because the side-cutters are well known to those skilled in the art, a detailed description is not given in this application. The side cutter has a convex upper surface, and consequently, a valley is formed between the two side cutters. In order to make robust use of this valley, a middle cutter assembly 1 is disposed therein. The middle cutter assembly 1 includes a comb 11, which can be removably attached to the comb mount 15. The comb 11 is provided with a plurality of openings 12 which are spaced apart and parallel to each other. Each opening 12 is isolated from the other openings. Using the middle cutter assembly 1, the elongate and planar configuration of a conventional middle cutter assembly has been completely modified, and close contact with the skin can therefore be attained.

Figure 3:
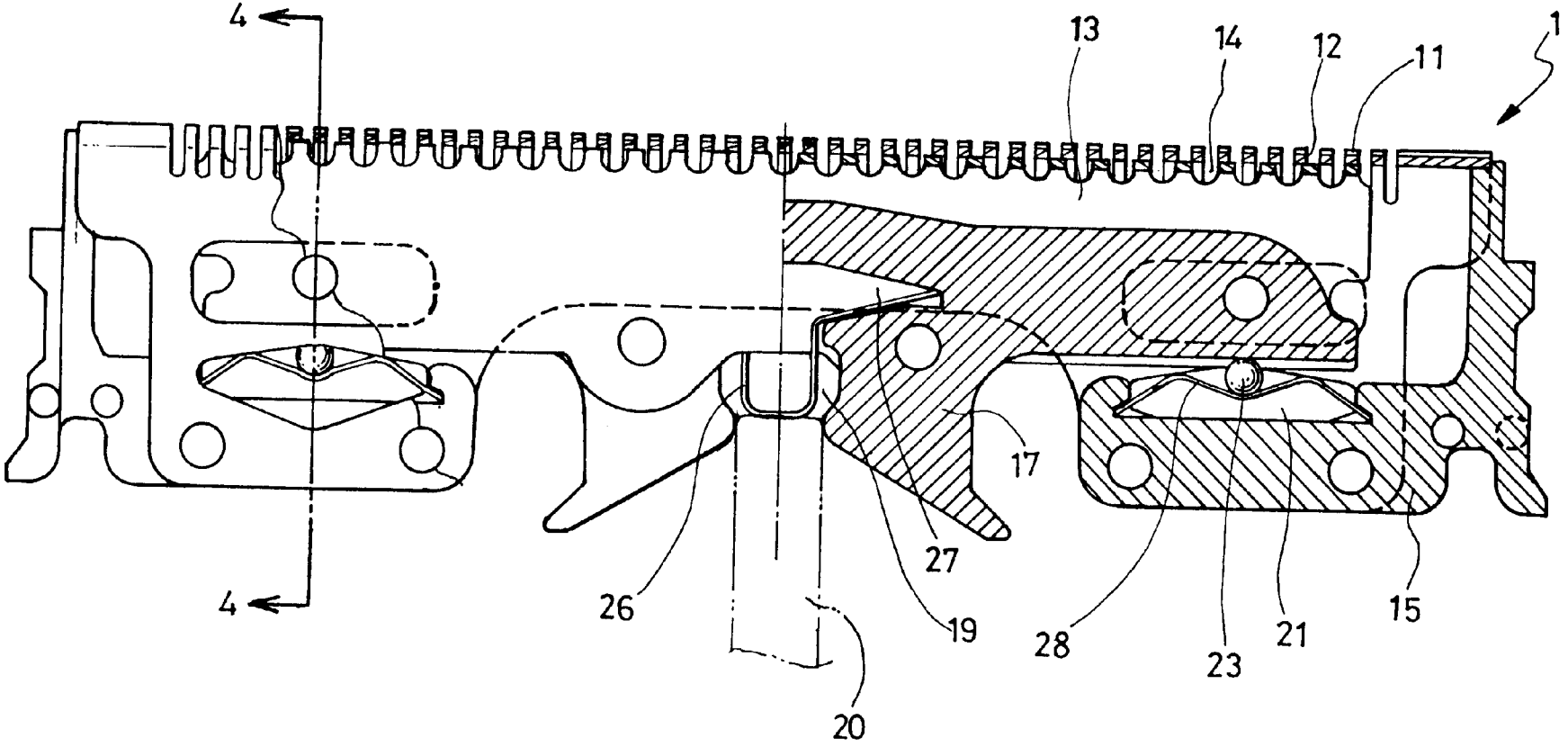
FIG. 3 is a partial sectional view of the supporting bracket shown in FIG. 1.
Figure 4:
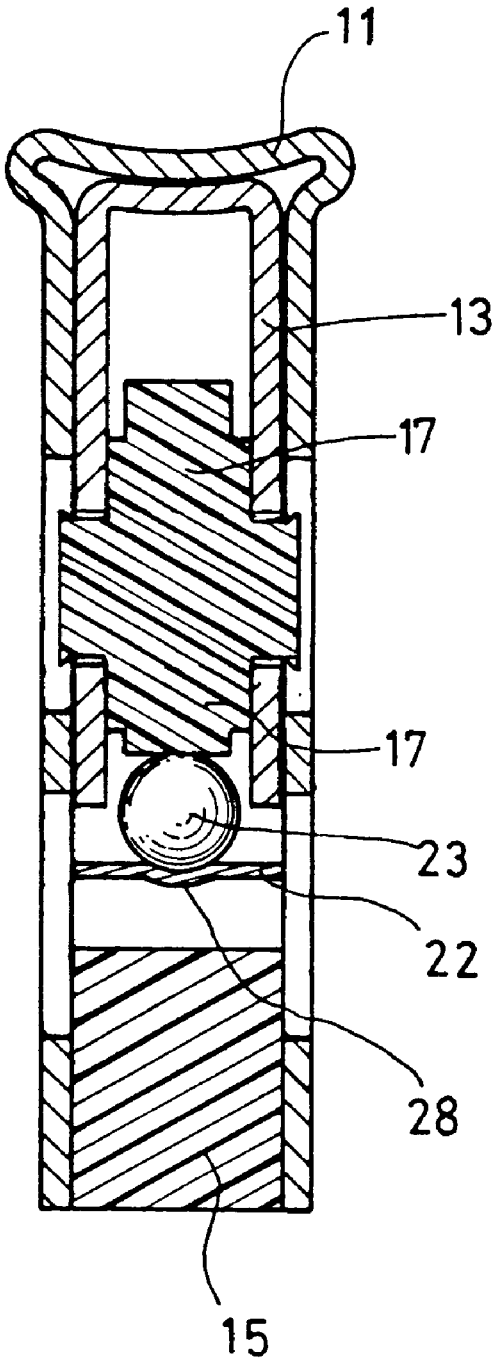
FIG. 4 is a side cross sectional view of the supporting bracket made according to the present invention.
Figure 5:
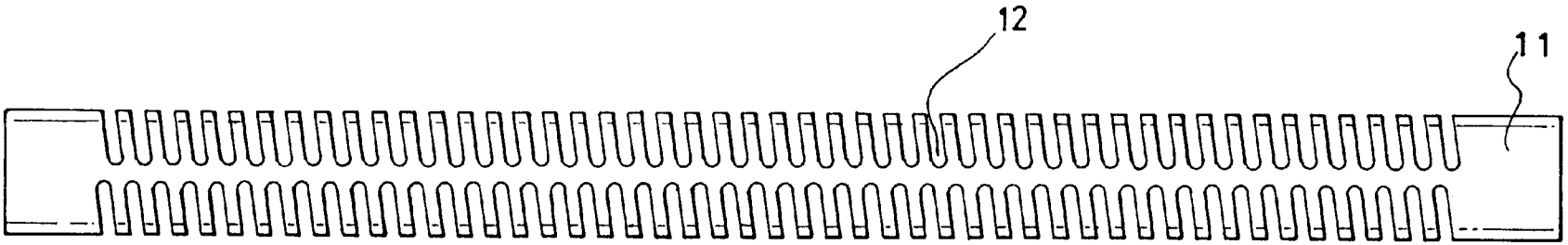
FIG. 5 is a top view of the comb according to the present invention.
Figure 6:
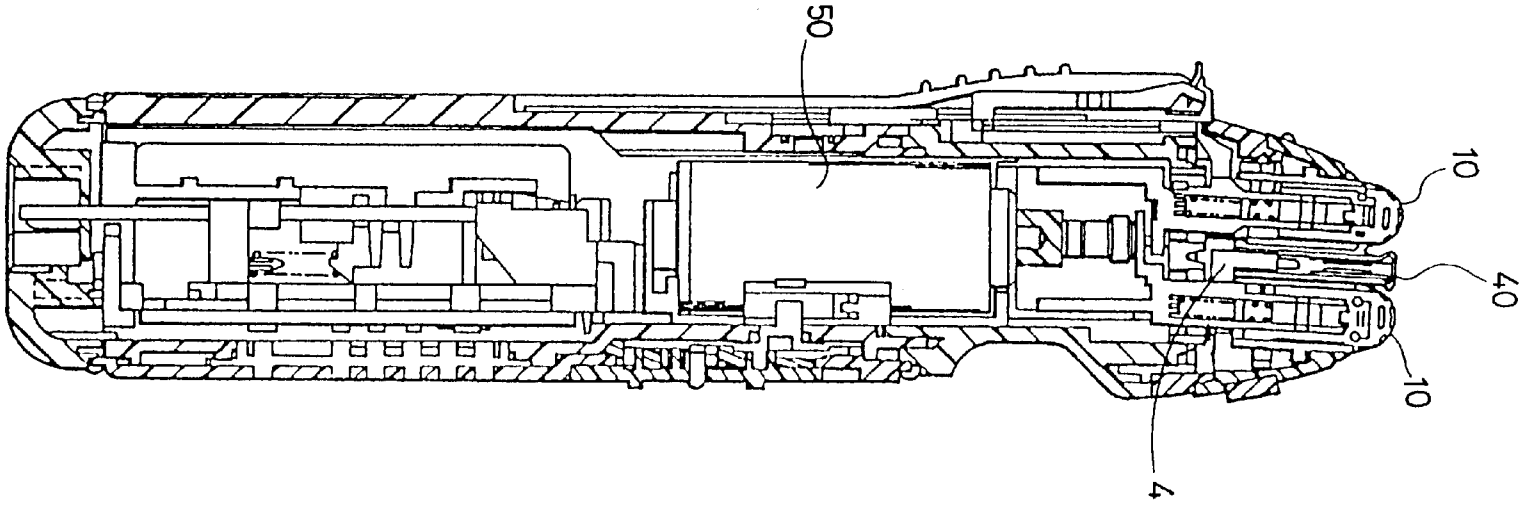
FIG. 6 (PRIOR ART)
FIG. 6 is a perspective view of a conventional middle supporting bracket and shaver assembly.
Figure 8:
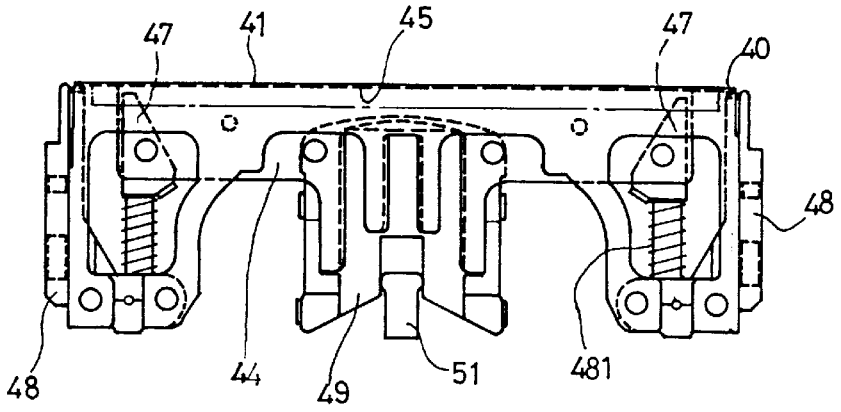
FIG. 8 (PRIOR ART)
FIG. 8 is a side elevational view of the conventional middle supporting bracket.
Figure 7:
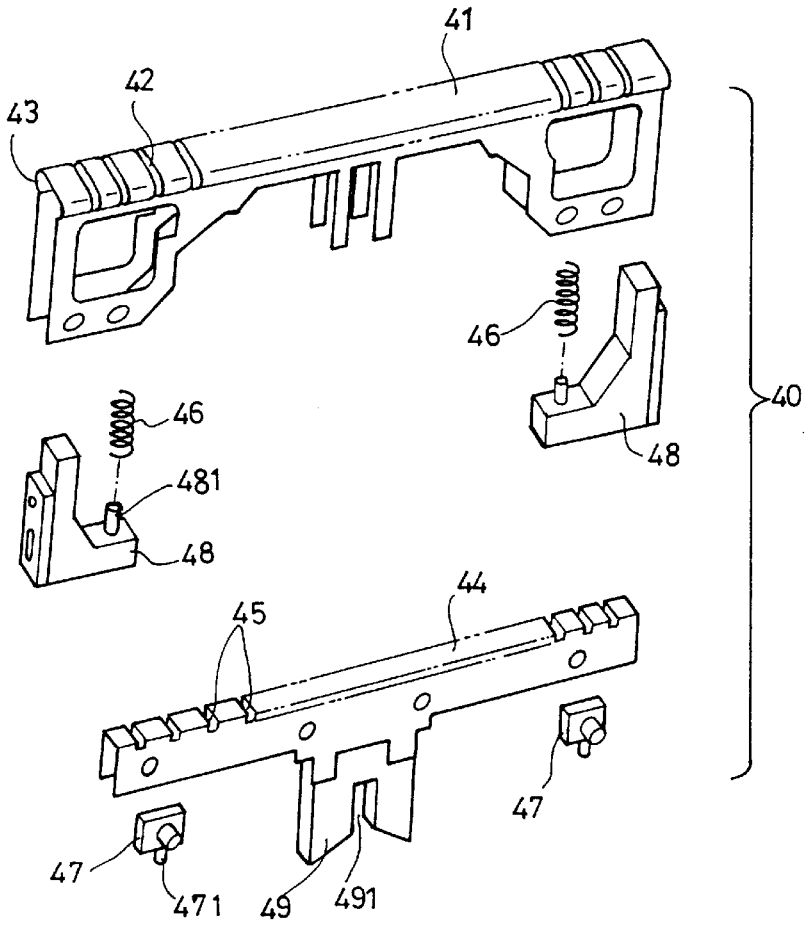
FIG. 7 (PRIOR ART)
FIG. 7 is an exploded perspective view of the conventional middle supporting bracket.

The inner surface of the comb 11 is tightly contacted with a cutter 13, which is shaped to match the contour of the comb 11, a concave shape. The cutter 13 is mounted on a cutter mount 17 and is also provided with a plurality of cutting grooves 14. The cutting grooves 14 can be configured as two types; one is the transverse type and the other is the bevel type. The bevel direction cutting grooves 14 are perpendicular to the opening 12 of the comb 11, as shown in FIG. 3. As a result, a V-shaped shear area is formed, and it can be applied for cutting beards. The comb 11 and the cutter 13 are all made from metal, wherein the comb 11 is fixedly mounted, and the cutter 13 is driven in an oscillating manner. When the cutter 13 is stopped, the cutting grooves 14 are offset from the openings 12. When the cutter 13 is relatively moved with respect to the comb 11, the inserted beard will be readily cut by the shearing movement of the openings 12 and the cutting grooves 14. Because the width of the cutter mount 17 is considerably larger than the driving arm 18, in order to ensure horizontal movement of the cutter 13 along the comb 11, both ends of the cutter mount 17 are suitably supported by a steel ball 23 biased by a W-shaped spring plate 22. The spring plate 22 is fixedly attached to the retaining groove 21 located at the surface of the comb mount 15. The comb mount 15 has an L-shaped configuration and is partially extended along the cutter mount 17, which has a T-shaped configuration. As a result, the cutter mount 17 contacts the inserting ends of the comb mount by its two wings. The cutter mount 17 is movably supported by the steel balls 23, which are biased by the spring plates 22, which in turn are supported by the retaining grooves 21 of the comb mounts 15. Accordingly, the cutter mount 17 can move in an oscillating manner with respect to the comb 11. Each side of the comb mount 15 is provided with four hookers that can be releasably engaged with the corresponding mounting holes of the comb. Each side of the cutter mount 17 is provided with a pair of hookers which can be releasably engaged with the cutter 13. By this arrangement, the comb 11 can be assembled to the comb mount 15 and the cutter 13 can be assembled to the cutter mount 17. The comb 11 has a wider portion at both ends, which is wider than the cutter 13. These wider portions are projected outward along the concave upper surface.

The cutter mount 17 is connected to the driving head 20 of a motor through a gap 19 formed between the driving arms 18. Each driving arm 18 is provided with a pair of sharpened bosses 24 that define a recessed portion 25 therebetween for movably mounting a U-shaped spring 26 therein. Both legs of the U-shaped spring 26 extend horizontally and outward like wings. Those extended legs are retained within a connecting groove 27 of the cutter mount 17. By this arrangement, when the spring 26 is contacted with the driving head 20 of a motor, the extended legs are deformed inward. The spring 26 is limited by the upper sharpened bosses 24, and no further deformation will be allowed. On the other hand, the spring 26 is also limited by the lower sharpened bosses 24, and as a result, the spring 26 will not move out. By this arrangement, a floating contact between the middle cutter 1 and the driving head 20 can be ensured. As a result, when the middle cutter is depressed, it can be readily moved downward. When the external force is released, the middle cutter returns to its original position. By this arrangement, close contact between the middle cutter and the skin can be attained when the middle cutter is moved along the skin. Furthermore, because the steel balls 23 are movably supported on the guiding grooves 28 of the spring plates 22, the cutter mount 17 can be balanced by the spring force of the spring plates 22. When the load on the cutter assembly 1 is not evenly distributed, the load can be evenly adjusted. The steel balls 23 are positioned as bearings by the guiding grooves 28. The steel balls 23 are moved only along the guiding grooves 28. Accordingly, the spring plates 22 will not be skewed back and forth as in conventional devices. In light of this, the comb 11 and the cutter 13 can be suitably balanced when relative movement therebetween is conducted. Furthermore, the frictional force therebetween is also reduced.

The comb mount 15 and the comb 11 are fixedly attached while the cutter 13 and the cutter mount 17 are movably supported. In order to ensure a horizontal and oscillating movement of the cutter 13 and the cutter mount 17, the cutter 13 closely contacts the comb 11 without a gap therebetween. By this arrangement, not only will the beard be readily cut off, but also the user will not experience a "pulling-out" of the beard. This is to say that the cutter 13 tightly contacts with the comb 11, and the frictional force therebetween is also lowered. By providing the steel balls 23, the movement of the cutter 13 and the cutter mount 17 can be even better ensured. From FIG. 4, it can be readily appreciated that a point-to-point contact between the cutter mount 17 and the steel balls 23 is established. On the other hand, the steel balls 23 are biased and limited by the spring plates 22, and the overall contact between the comb 11 and the cutter 13 can be further adjusted and ensured. By the way, because the U-shaped spring 26 is disposed between the cutter mount 17 and the driving head 20 of the motor, the balance is further enhanced.

From the foregoing description, one can readily see that the main purpose of the present invention is to provide a balanced support to a cutter mount using retaining grooves and steel balls that are biased by spring plates, i.e., the central line of the cutter mount is substantially balanced with the steel balls. By this arrangement, a tight relationship between the comb and the cutter is attained. When an external force is applied, the external force can be readily transmitted to the steel balls. However, this external force will be suitably and evenly distributed such that the cutter is adequately balanced, i.e., the bottom of the central line of the cutter mount is always perpendicular to the apex of the steel ball, and the steel ball has only point-to-point contact with the cutter mount. Because the steel balls are movably held within the retaining grooves, when the external force exceeds a certain limit, the spring plates may readily deform to shift this force. However, the spring plates have excellent resilient capability, and the steel balls can be suitably retained within the retaining grooves. By this arrangement, the cutter mount will not shift away, and the longer beard can be properly cut without being clipped to pull out. Accordingly, the longer beard first will be cut by the middle cutter and then further shaved by the side cutters. In light of this, beards can be suitably cut by the joint cutting movement of the middle cutter and the side cutters. With a single movement of the shaver, beards can be clearly cut out. This is apparently superior to conventional shavers.

While a particular embodiment of the present invention has been illustrated and described, those skilled in the art will appreciate that various changes and modifications can be made without departing from the spirit and scope of the invention. It is therefore intended to cover in the appended claims all such changes and modifications that are within the scope of the present invention.

I claim:

1. A middle cutter of a shaver, comprising:

a comb having a U-shaped configuration, wherein an upper surface of the comb includes a plurality of openings defined therein, wherein each opening is isolated from the other openings;

a first comb mount on which the comb is removably mounted, wherein the first comb mount has an L-shaped configuration and includes: (a) a first retaining groove defined at an upper surface of the first comb mount, and (b) hookers for removably engaging the first comb mount with the comb;

a second comb mount on which the comb is removably mounted, wherein the second comb mount has an L-shaped configuration and includes: (a) a second retaining groove defined at an upper surface of the second comb mount, and (b) hookers for removably engaging the second comb mount with the comb;

a cutter in tight contact with an inner surface of the comb, wherein the cutter has a U-shaped configuration, and wherein an upper surface of the cutter is provided with a plurality of cutting grooves;

a cutter mount on which the cutter is mounted, wherein the cutter mount has a T-shaped configuration with two top ends, and wherein the two top ends contact with a side portion of the cutter;

a first W-shaped spring plate, wherein the first spring plate is retained in the first retaining groove of the first comb mount;

a second W-shaped spring plate, wherein the second spring plate is retained in the second retaining groove of the second comb mount;

a first steel ball movably received on the first W-shaped spring plate; and a second steel ball movably received on the second W-shaped spring plate;

wherein an upper portion of the first steel ball and an upper portion of the second steel ball are biased against the cutter mount by the first and second spring plates, respectively, such that the cutter mount is held in a balanced manner and maintains tight contact between the cutter and the comb.

2. A middle cutter of a shaver as recited in claim 1, further including:

a motor, including a driving head; and a U-shaped spring having a first leg and a second leg, wherein the cutter mount includes a pair of driving arms, and a gap is defined between the driving arms, wherein the driving head of the motor is engaged with the cutter mount at the gap, wherein each of the driving arms includes an upper sharpened boss and a lower sharpened boss, wherein the sharpened bosses define a recessed portion in which the U-shaped spring is mounted, wherein the first leg of the U-shaped spring extends outward and is retained within a first connecting groove defined in the cutter mount, and the second leg of the U-shaped spring extends outward and is retained within a second connecting groove defined in the cutter mount, wherein the U-shaped spring is retained in the first and second connecting grooves of the cutter mount in such a manner that the U-shaped spring is limited by the upper sharpened bosses of the driving arms of the cutter mount.

3. A middle cutter of a shaver as recited in claim 2, wherein the upper surface of the comb and the upper surface of the cutter each are configured with a concave shape.

4. A middle cutter of a shaver as recited in claim 2, wherein the cutting grooves of the cutter move while the openings of the comb are fixed.

5. A middle cutter of a shaver as recited in claim 1, wherein the upper surface of the comb and the upper surface of the cutter each are configured with a concave shape.

6. A middle cutter of a shaver as recited in claim 1, wherein the cutting grooves of the cutter move while the openings of the comb are fixed.

7. A middle cutter of a shaver, comprising:

a comb having an upper surface that includes a plurality of openings defined therein;

a first comb mount on which the comb is mounted, wherein the first comb mount includes: (a) a first retaining groove defined at an upper surface of the first comb mount, and (b) hookers for engaging the first comb mount with the comb;

a second comb mount on which the comb is mounted, wherein the second comb mount includes: (a) a second retaining groove defined at an upper surface of the second comb mount, and (b) hookers for engaging the second comb mount with the comb;

a cutter in tight contact with an inner surface of the comb, wherein an upper surface of the cutter is provided with a plurality of cutting grooves;

a cutter mount on which the cutter is mounted;

a first spring plate retained in the first retaining groove of the first comb mount;

a second spring plate retained in the second retaining groove of the second comb mount;

a first ball movably received on the first spring plate; and a second ball movably received on the second spring plate;

wherein an upper portion of the first ball and an upper portion of the second ball are biased against the cutter mount by the first and second spring plates, respectively, such that the cutter mount is held in a balanced manner and maintains tight contact between the cutter and the comb.

8. A middle cutter of a shaver as recited in claim 7, further including:

a motor, including a driving head; and a U-shaped spring having a first leg and a second leg, wherein the cutter mount includes a pair of driving arms, and a gap is defined between the driving arms, wherein the driving head of the motor is engaged with the cutter mount at the gap, wherein each of the driving arms includes an upper sharpened boss and a lower sharpened boss, wherein the sharpened bosses define a recessed portion in which the U-shaped spring is mounted, wherein the first leg of the U-shaped spring extends outward and is retained within a first connecting groove defined in the cutter mount, and the second leg of the U-shaped spring extends outward and is retained within a second connecting groove defined in the cutter mount, wherein the U-shaped spring is retained in the first and second connecting grooves of the cutter mount in such a manner that the U-shaped spring is limited by the upper sharpened bosses of the driving arms of the cutter mount.

9. A middle cutter of a shaver as recited in claim 8, wherein the upper surface of the comb and the upper surface of the cutter each are configured with a concave shape.

10. A middle cutter of a shaver as recited in claim 8, wherein the cutting grooves of the cutter move while the openings of the comb are fixed.

11. A middle cutter of a shaver as recited in claim 7, wherein the upper surface of the comb and the upper surface of the cutter each are configured with a concave shape.

12. A middle cutter of a shaver as recited in claim 7, wherein the cutting grooves of the cutter move while the openings of the comb are fixed.

* * * * *